US012171319B2

(12) United States Patent
Bourguignat et al.

(10) Patent No.: US 12,171,319 B2
(45) Date of Patent: Dec. 24, 2024

(54) APPLICATOR SYSTEM FOR APPLYING A COSMETIC PRODUCT

(71) Applicant: ELC MANAGEMENT LLC, Melville, NY (US)

(72) Inventors: David Bourguignat, Brooklyn, NY (US); Marc Emile Lechanoine, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 306 days.

(21) Appl. No.: 17/682,661

(22) Filed: Feb. 28, 2022

(65) Prior Publication Data

US 2023/0270232 A1 Aug. 31, 2023

(51) Int. Cl.
*A45D 34/04* (2006.01)
*A45D 40/26* (2006.01)

(52) U.S. Cl.
CPC ..... *A45D 34/04* (2013.01); *A45D 34/045* (2013.01); *A45D 40/265* (2013.01); *A45D 2200/055* (2013.01); *A45D 2200/1009* (2013.01); *A45D 2200/20* (2013.01)

(58) Field of Classification Search
CPC ..... A45D 34/04
USPC ..... 401/126, 127, 130; 132/293–307
See application file for complete search history.

(56) References Cited

U.S. PATENT DOCUMENTS 1,362,808 A * 12/1920 Mcfarland ..... A45D 40/265 401/126
RE21,757 E * 4/1941 Deakers et al. ..... A45D 40/265 401/128
5,357,987 A 10/1994 Schrepf
5,636,931 A 6/1997 Gueret
7,171,969 B2 2/2007 Gueret
9,271,557 B2 3/2016 Corbellini et al.
(Continued)

FOREIGN PATENT DOCUMENTS

JP H07-313247 A 12/1995
JP 2021-164528 A 10/2021
KR 101923187 B1 11/2018

OTHER PUBLICATIONS

International Application No. PCT/US2022/050642, International Search Report and Written Opinion, mailed Apr. 25, 2023.
(Continued)

*Primary Examiner* — David J Walczak
(74) *Attorney, Agent, or Firm* — MARSHALL, GERSTEIN & BORUN LLP

(57) ABSTRACT

An applicator system for containing and dispensing a cosmetic product may include a body including a first end, a second end, and defining an interior cavity, a container at least partially disposed within the cavity of the body and defining a cavity containing a cosmetic substance, a sifter positioned adjacent to the container to retain the cosmetic substance within the cavity, a handle having first and second ends and defining an interior cavity, an inner handle positioned at the first end of the handle, and an applicator. The first end of the handle operably couples with the first end of the body. The inner handle includes an applicator coupling mechanism to which the applicator operably couples. Upon operably coupling the first ends of the body and the handle, the applicator is positioned adjacent to the sifter, thereby collecting a quantity of cosmetic substance.

15 Claims, 16 Drawing Sheets

(56) References Cited

U.S. PATENT DOCUMENTS

| | | | |
|---|---|---|---|
| 9,545,143 | B1 | 1/2017 | Jacob et al. |
| 2004/0226573 | A1 | 11/2004 | Gueret |
| 2015/0257510 | A1 | 9/2015 | Kim |
| 2018/0279743 | A1 | 10/2018 | Yoo |
| 2021/0219697 | A1 | 7/2021 | Joung |
| 2021/0307489 | A1 | 10/2021 | Butcher |

OTHER PUBLICATIONS

International Application No. PCT/US2023/063118, International Search Report and Written Opinion, mailed Jun. 19, 2023.

* cited by examiner

APPLICATOR SYSTEM FOR APPLYING A COSMETIC PRODUCT

FIELD OF THE DISCLOSURE

The present disclosure generally relates to cosmetic, hair care, body care, and/or skincare products and, more particularly, to systems and approaches for applying such products.

BACKGROUND

Cosmetic, hair care, body care, and/or skincare products may be provided in a number of different containers, and may be applied using a number of varying approaches. As an example, a concealer product may be applied using a user's finger, an applicator brush, and/or a sponge product, among other alternatives. When applying such products, it may be difficult for a user to accurately dispense an appropriate quantity of product to provide coverage for the desired area. In instances where too much product is dispensed from the container, the excess product may be difficult and/or impossible to return to its container, and ultimately may need to be discarded, thereby resulting in wasted product. Conversely, in instances where too little product is dispensed from the container, the user's experience may be adversely impacted due to needing to repeatedly dispense additional product. Additionally, existing approaches may lack customization capabilities and may be difficult to use when attempting specific application techniques. Further, existing products may be disposable in nature, and as such may lead to environmental waste.

Accordingly, there is a need for improved accessories having improved functionalities.

SUMMARY

Examples within the scope of the present disclosure are directed to an applicator system for containing and dispensing a cosmetic substance. Such a system may include a body including a first end, a second end, and defining an interior cavity, a container at least partially disposed within the cavity of the body and defining a cavity containing a cosmetic substance, a sifter positioned adjacent to the container to retain the cosmetic substance within the cavity, a handle having first and second ends and defining an interior cavity, an inner handle positioned at the first end of the handle, and an applicator. The first end of the handle operably couples with the first end of the body. The inner handle includes an applicator coupling mechanism to which the applicator operably couples. Upon operably coupling the first ends of the body and the handle, the applicator is positioned adjacent to the sifter, thereby collecting a quantity of cosmetic substance.

In an approach, the container is movably disposed within the body between the second end to the first end thereof. Further, in these and other approaches, the applicator system may include a piston assembly positioned at the second end of the body. The piston assembly may urge the container towards the first end of the body. Further, the piston assembly may include a resilient member operably coupled with the second end of the body. In some examples, the piston assembly may generate a surface tension between the sifter and the cosmetic substance. Upon operably coupling the first end of the body with the first end of the handle, the applicator may break the generated surface tension to cause the quantity of cosmetic substance to be collected thereon.

In some examples, the applicator may be removably coupled with the applicator coupling mechanism of the inner handle. In some forms, the sifter may include an abutment to prevent the applicator from advancing into the container.

In some examples, the first end of the body is threadably coupled with the first end of the handle. Further, in some approaches, the second end of the body may be removable to allow the container to be removed therefrom. In some approaches, the handle and the inner handle may be integrally formed.

In some forms, the sifter may at be at least partially constructed from a mesh material having a plurality of openings. In some of these examples, the sifter may be in the form of a movable member that translates within the interior cavity of the body.

In accordance with a second aspect, an approach for automatically dispensing a cosmetic substance is provided that includes providing a body that includes a first end, a second end, and defining an interior cavity and including a container at least partially disposed therein which defines a cavity containing a cosmetic substance. A sifter is positioned adjacent to the container to retain the cosmetic substance within the cavity. A first end of a handle is operably coupled with the first end of the body. The handle includes an interior cavity and an inner handle positioned at the first end of the handle. The inner handle is operably coupled with an applicator. Operably coupling the first end of the handle with the first end of the body causes the applicator to contact the sifter and collect a quantity of cosmetic substance. The approach further includes decoupling the handle from the body to expose the applicator.

In accordance with a third aspect, an applicator system for containing and dispensing a cosmetic substance includes a body including a first end, a second end, and defining an interior cavity, a container at least partially disposed within the body that defines a cavity containing a cosmetic substance and being movable in an axial direction between the second end of the body and the first end of the body, a sifter positioned adjacent to the container to retain the cosmetic substance within the cavity, and a piston assembly positioned at the second end of the body. The piston assembly is adapted to urge the container towards the first end of the body.

BRIEF DESCRIPTION OF THE DRAWINGS

The above needs are at least partially met through provision of one, more than one, or any combination of the approaches for applicator systems for applying a cosmetic product described in the following detailed description, particularly when studied in conjunction with the drawings, wherein.

Figure 1:
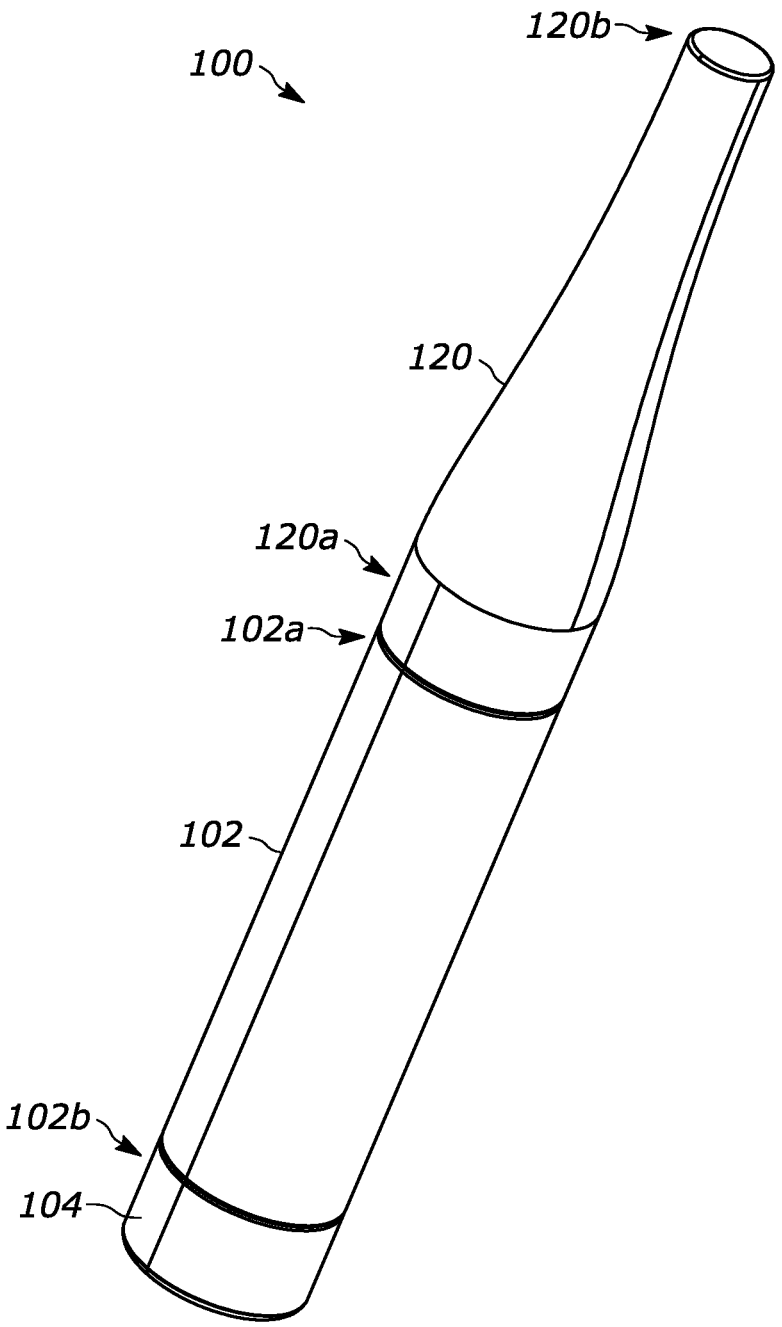
FIG. 1 illustrates a perspective view of an example applicator system in accordance with various examples.
Figure 3:
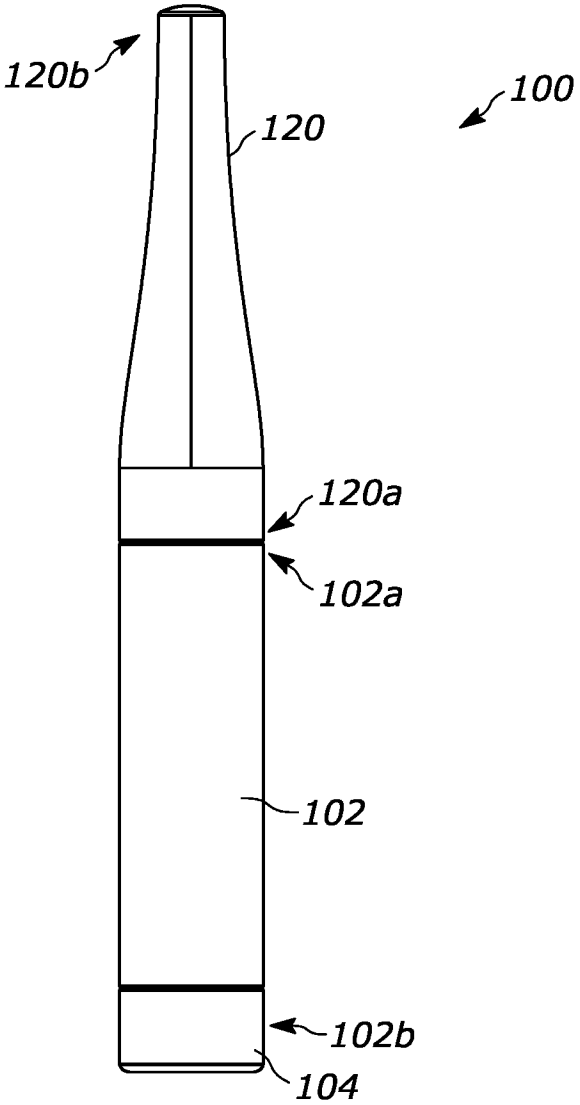
FIG. 3 illustrates a front elevation view of the example applicator system of FIGS. 1 & 2 in accordance with various examples.
Figure 2:
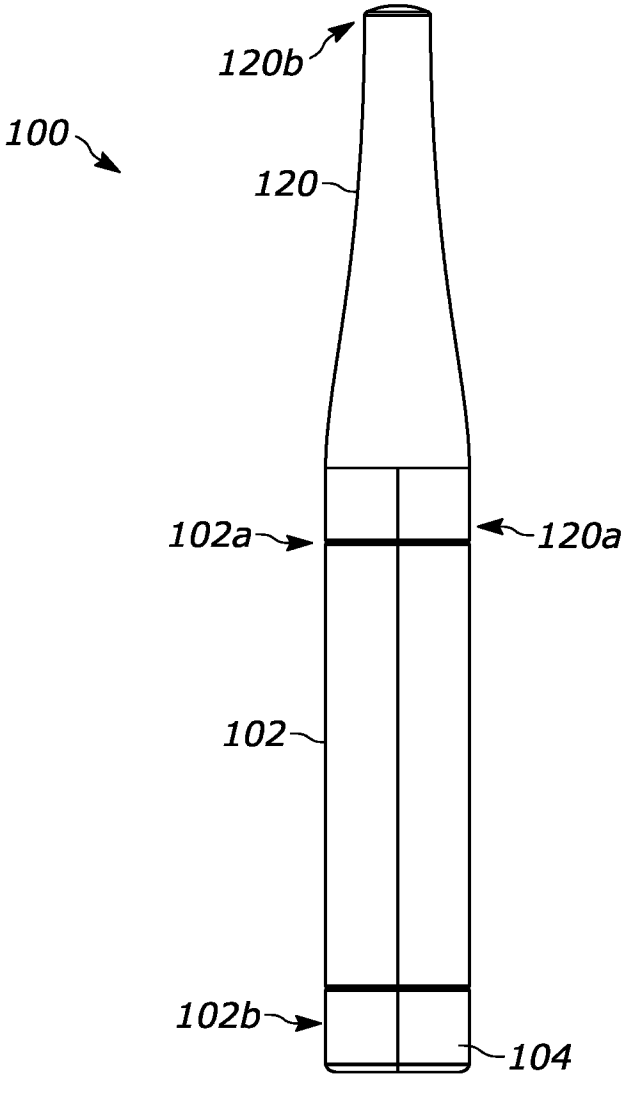
FIG. 2 illustrates a side elevation view of the example applicator system of FIG. 1 in accordance with various examples.
Figure 4:
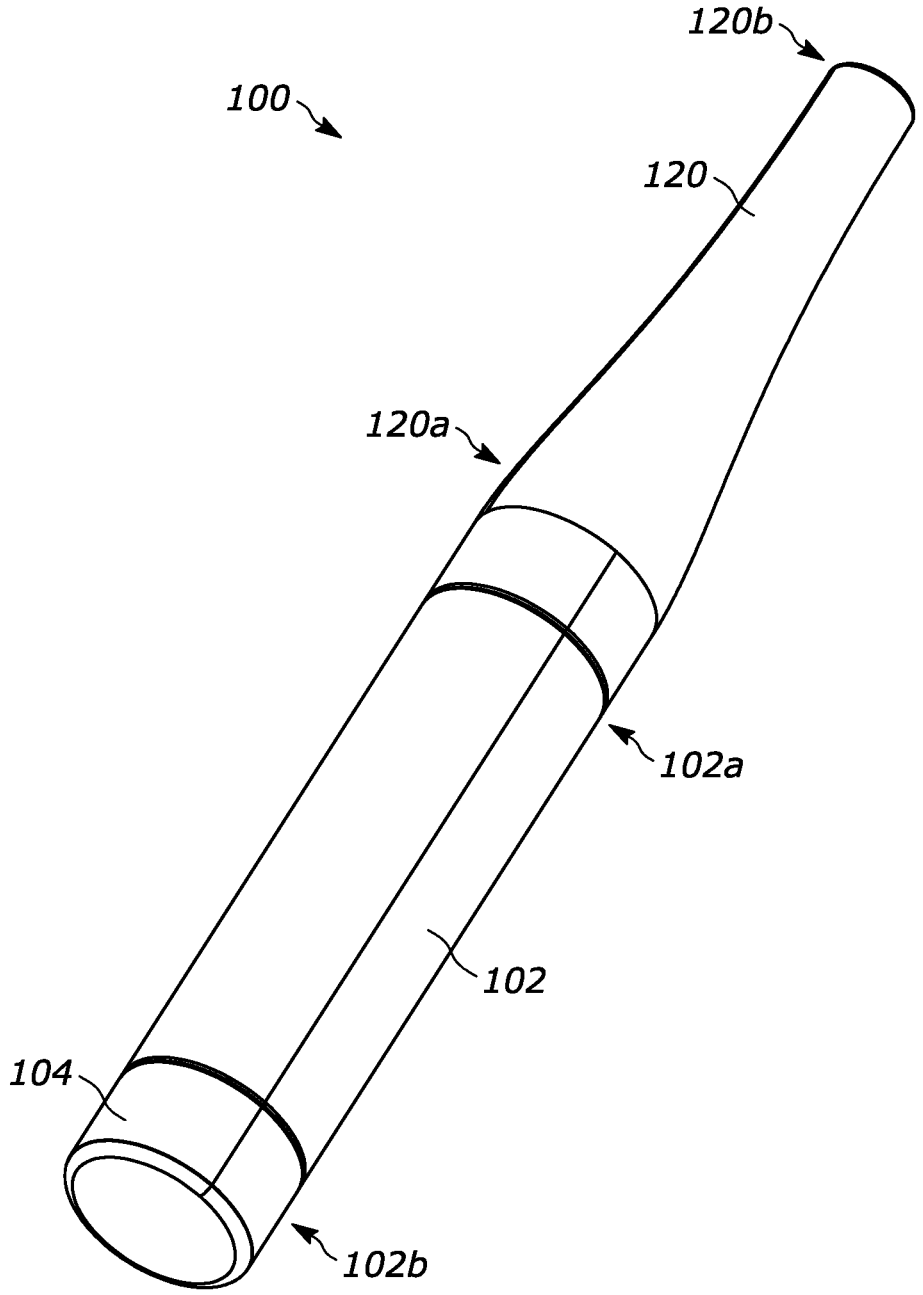
FIG. 4 illustrates a lower perspective view of the example applicator system of FIGS. 1-3 in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, an applicator system is provided that allows a user to precisely dispense and apply a controlled, predetermined quantity (e.g., a micro dosage) of a cosmetic, a hair care, a body care, and/or a skincare product such as, for example, a concealer formula, and allows the product to be applied and blended in an ergonomic and even manner. In some examples, the system may reduce air bubbles and/or other inconsistencies during dispensing and application, thereby providing a smooth application that reduces and/or eliminates texture marks.

Turning to the Figures, an applicator system 100 is provided for containing and dispensing a cosmetic substance 101. The applicator system 100 includes a body or cap 102, a container 110, a handle 120, an inner handle 130, and an applicator 140. The cosmetic substance 101 may be any type of cosmetic, hair care, body care, and/or skincare product that may be applied to a user. For example, the cosmetic substance 101 may be in the form of a concealer formula. Other examples are possible. In some examples where the cosmetic substance 101 is a cosmetic formula, it may include strong or otherwise aggressive chemicals and/or solvents such as, for example, volatiles.

Figure 8:
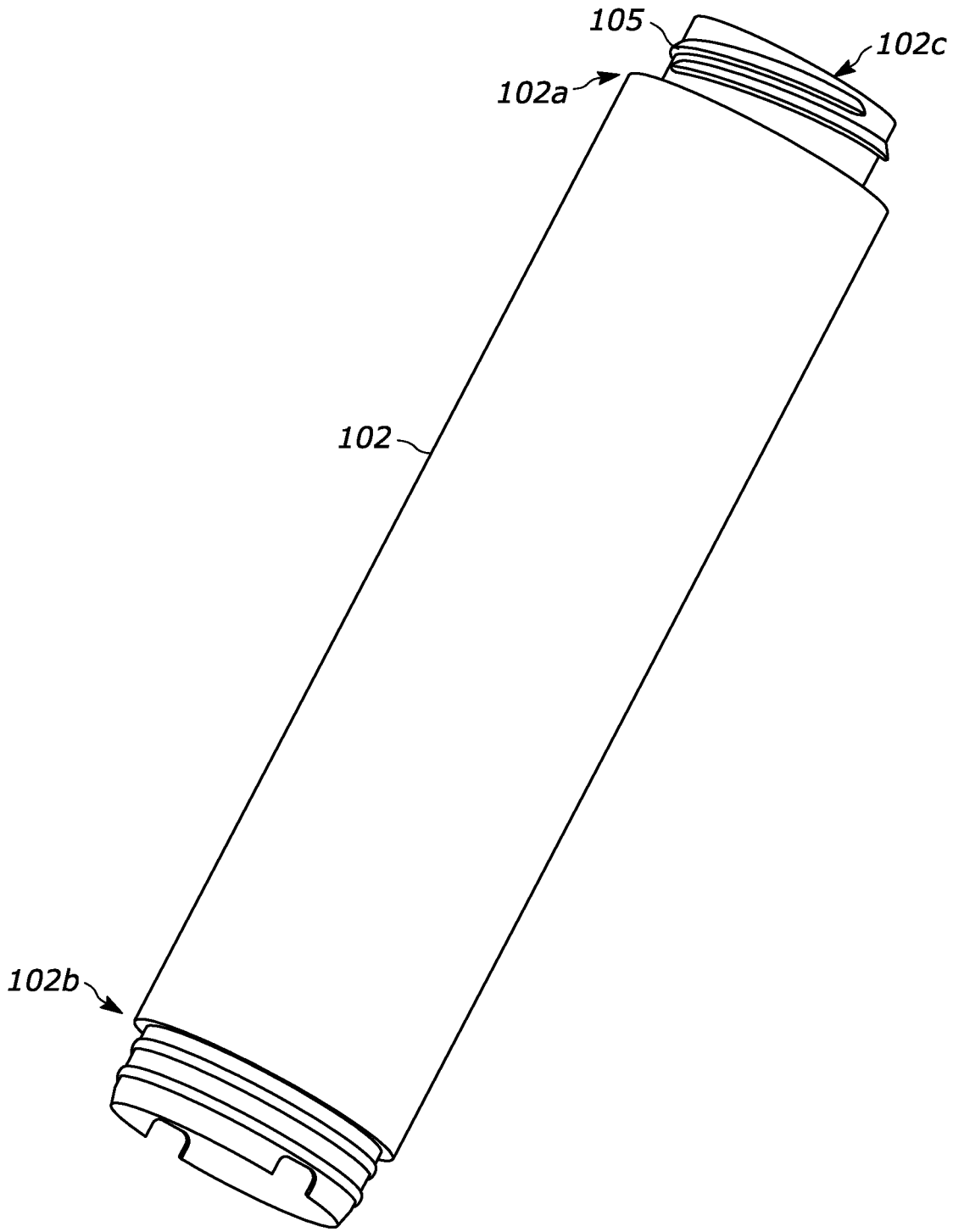
FIG. 8 illustrates a perspective view of an example body of the example applicator system of FIGS. 1-7 in accordance with various examples.
Figure 9:
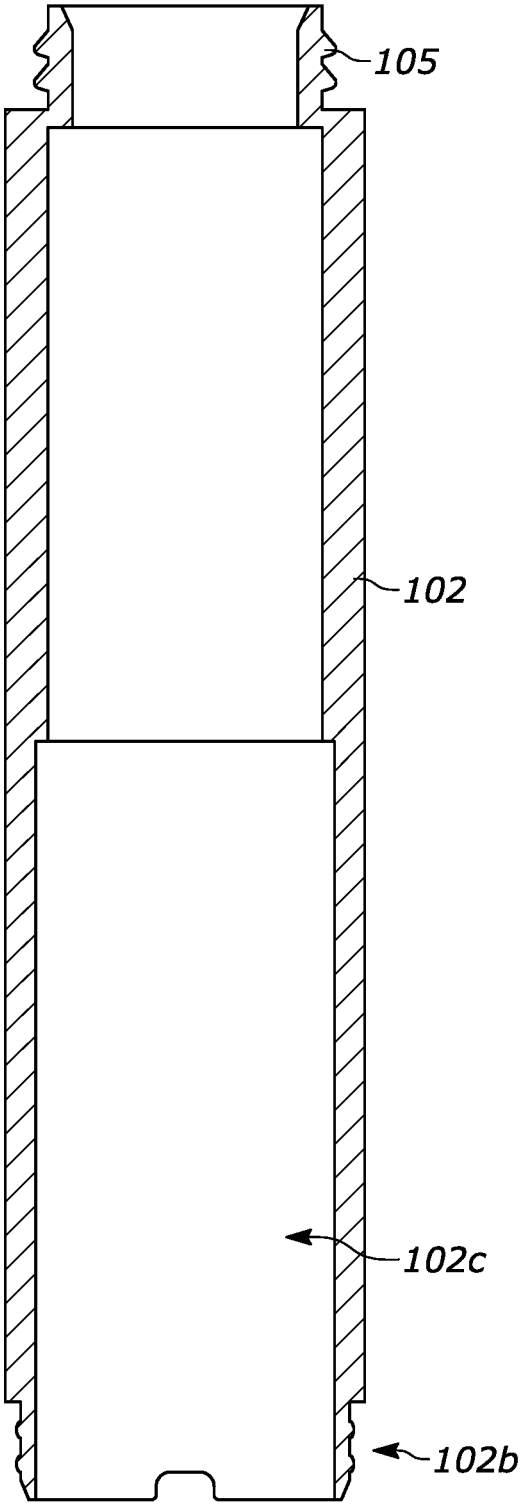
FIG. 9 illustrates a front elevation cross-sectional view of the example body of the example applicator system of FIGS. 1-8 in accordance with various examples.

With particular reference to FIGS. 8 and 9, the body 102 includes a first end 102*a*, a second end 102*b*, and defines an interior cavity 102*c*. In the illustrated example, the first end 102*a* of the body 102 is generally open, and the second end 102*b* of the body 102 is closed. In some examples, a separate body plug 104 is provided that removably couples with the second end 102*b* of the body 102 to create a closed member. In the illustrated examples, the coupling between the body plug 104 and the body 102 may be a threaded connection. However, other arrangements (e.g., a friction-fit coupling) are possible. The first end 102*a* of the body 102 includes a coupling region 105 which, in the illustrated examples, is in the form of a threaded connection positioned on an exterior surface of the body 102. However, other arrangements are possible.

Figure 5:
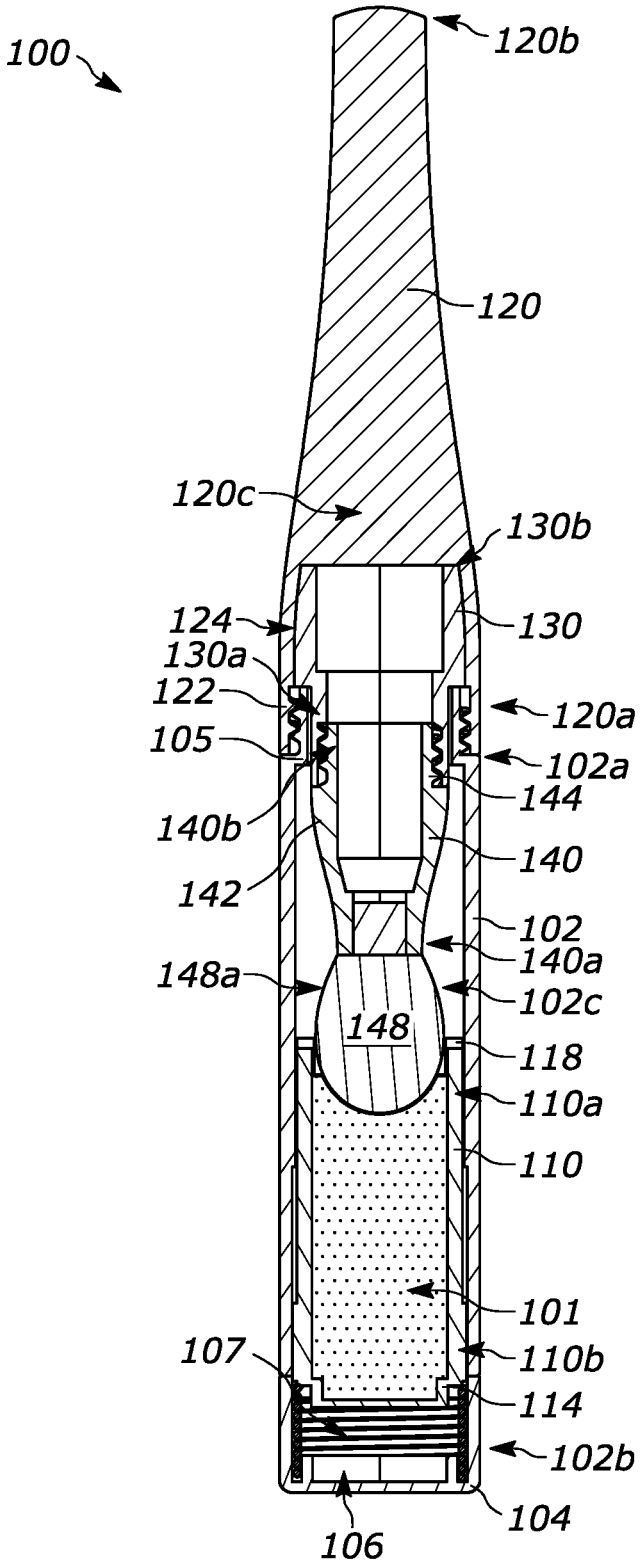
FIG. 5 illustrates a front elevation cross-sectional view of the example applicator system of FIGS. 1-4 in accordance with various examples.
Figure 7:
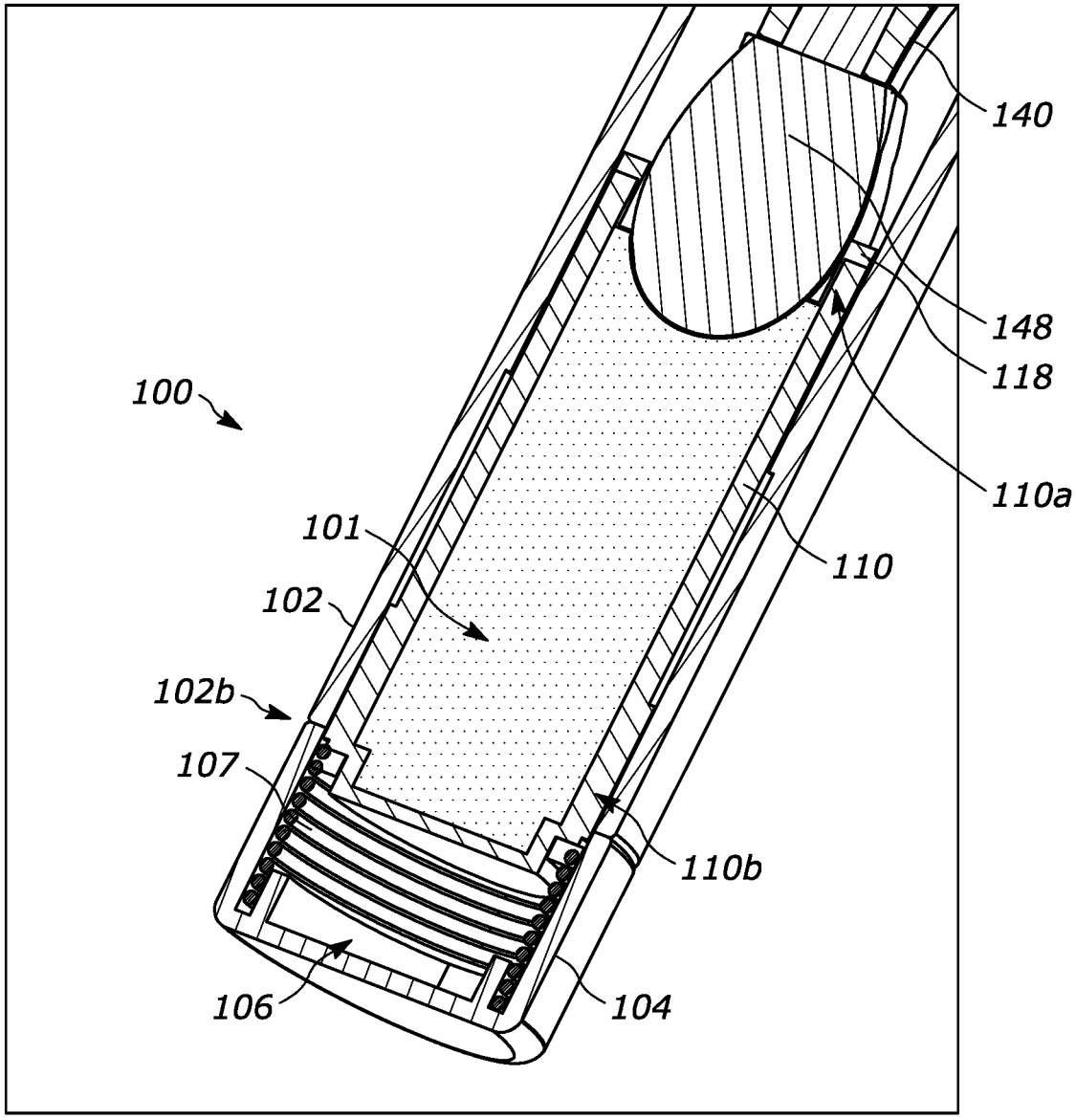
FIG. 7 illustrates a perspective cross-sectional view of the example applicator system of FIGS. 1-6 in accordance with various examples.
Figure 10:
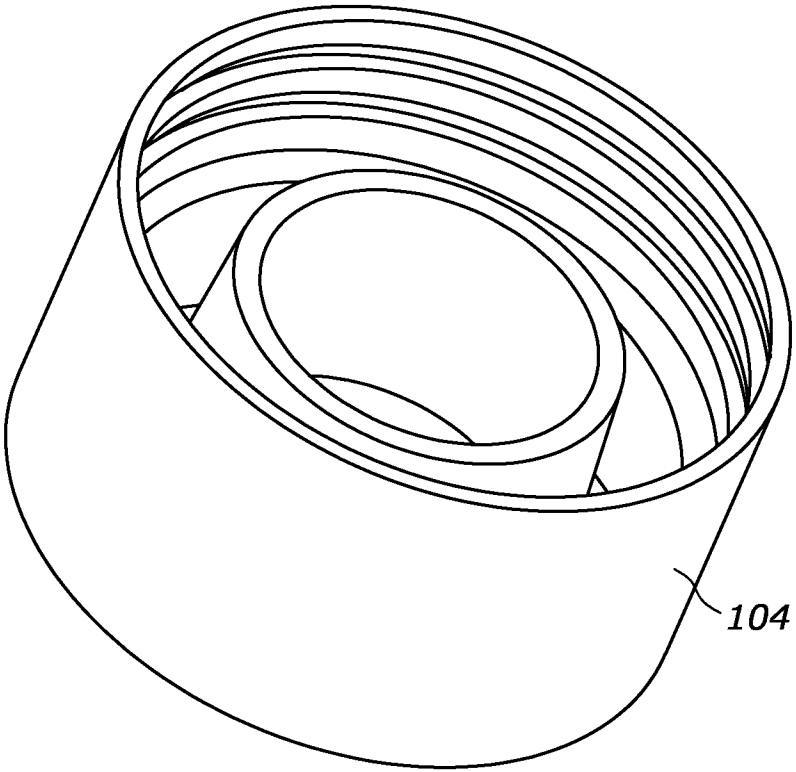
FIG. 10 illustrates a perspective view of an example body plug of the example applicator system of FIGS. 1-9 in accordance with various examples.

A piston assembly 106 is disposed within the body 102. The piston assembly 106 includes a resilient member 107. As illustrated in FIGS. 5, 7, and 10, the resilient member 107 is positioned and/or otherwise disposed within a corresponding groove or channel formed in the body plug 104 (or merely the second end of the body in examples where a separate body plug is not provided). As will be discussed in further detail below, the piston assembly 106 provides an urging force on at least a portion of the container 110 to urge the container 110 towards the first end 102*a* of the body 102.

Figure 11:
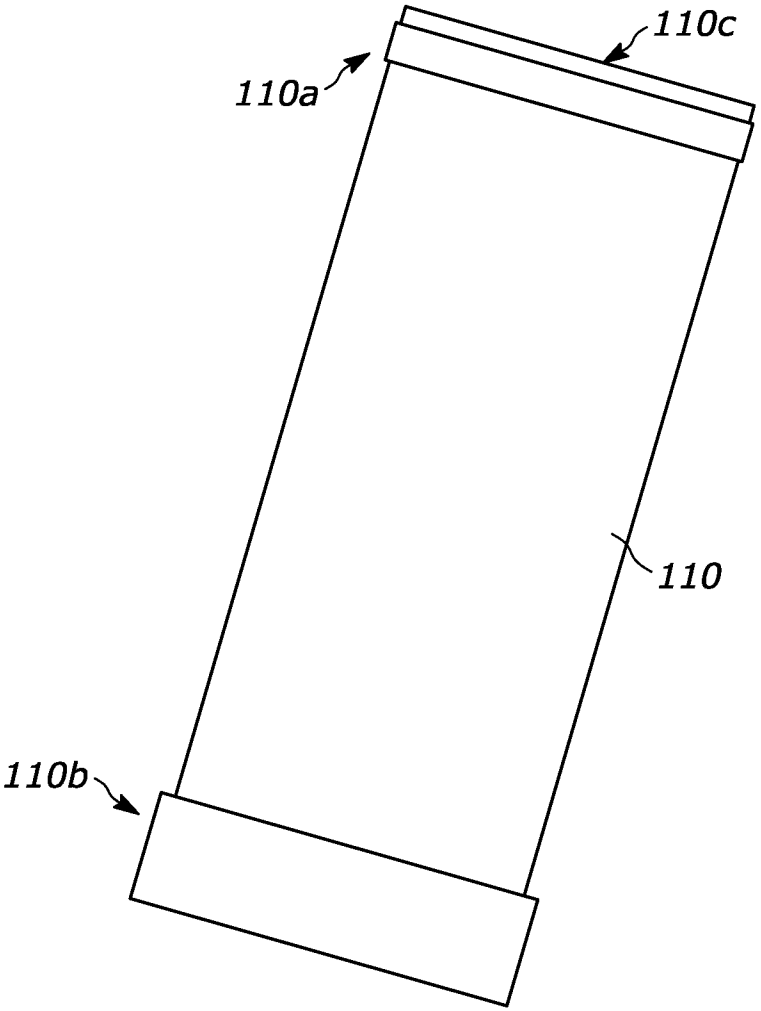
FIG. 11 illustrates a perspective view of an example container of the example applicator system of FIGS. 1-10 in accordance with various examples.
Figure 12:
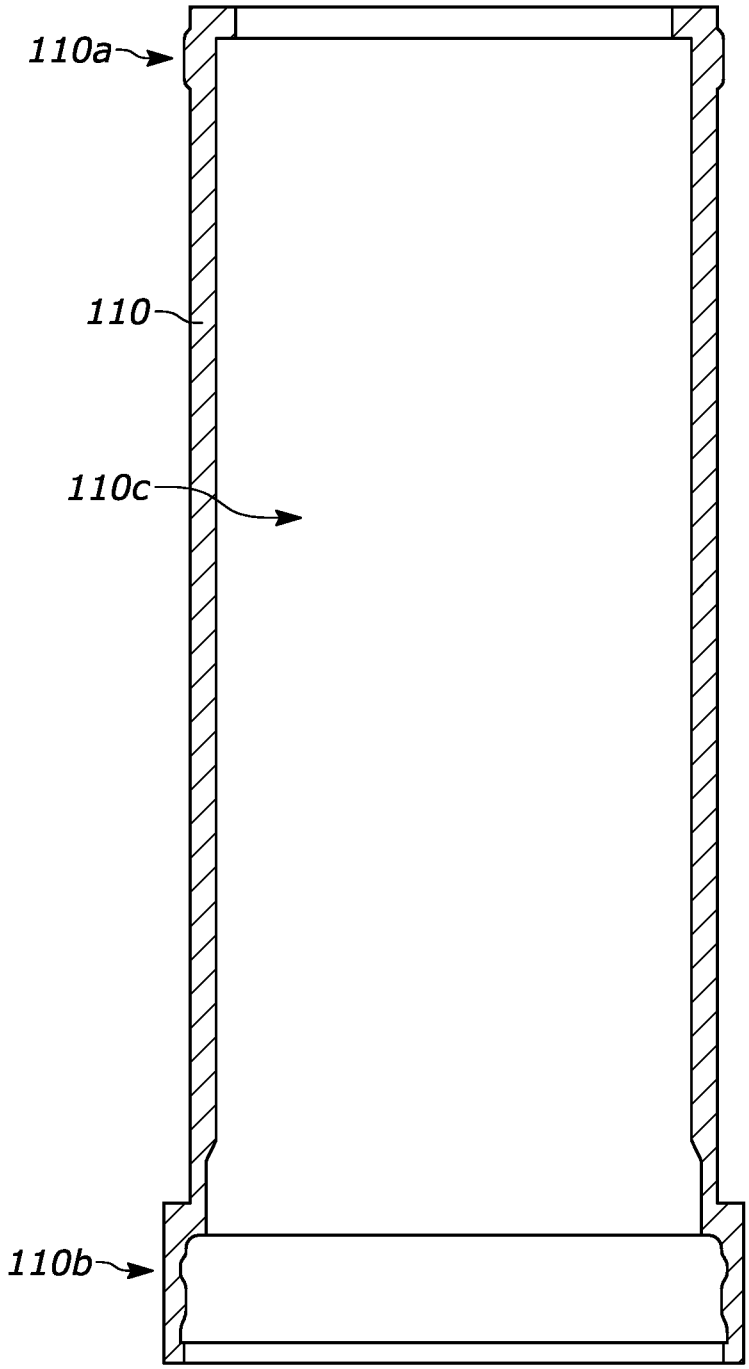
FIG. 12 illustrates a front elevation cross-sectional view of the example container of the example applicator system of FIGS. 1-11 in accordance with various examples.
Figure 13:
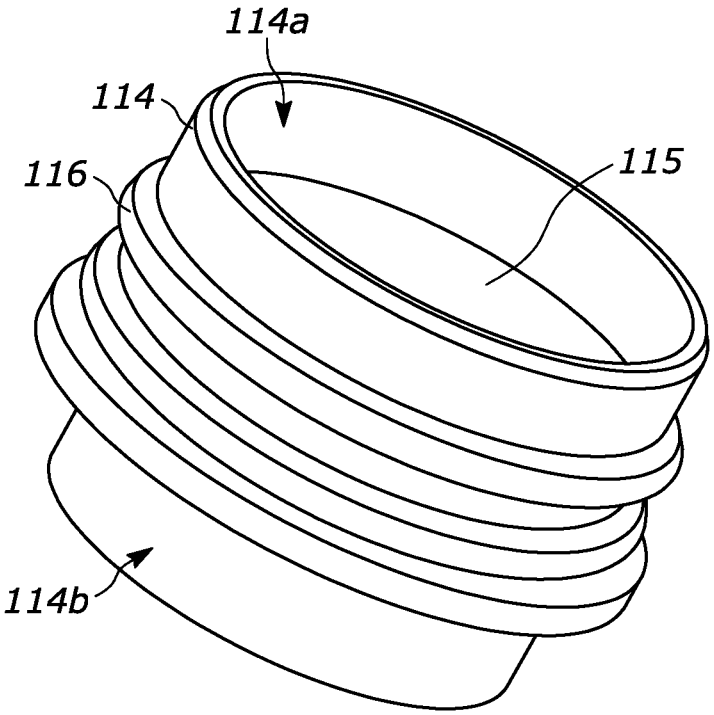
FIG. 13 illustrates a perspective view of an example container plug of the example applicator system of FIGS. 1-12 in accordance with various examples.
Figure 14:
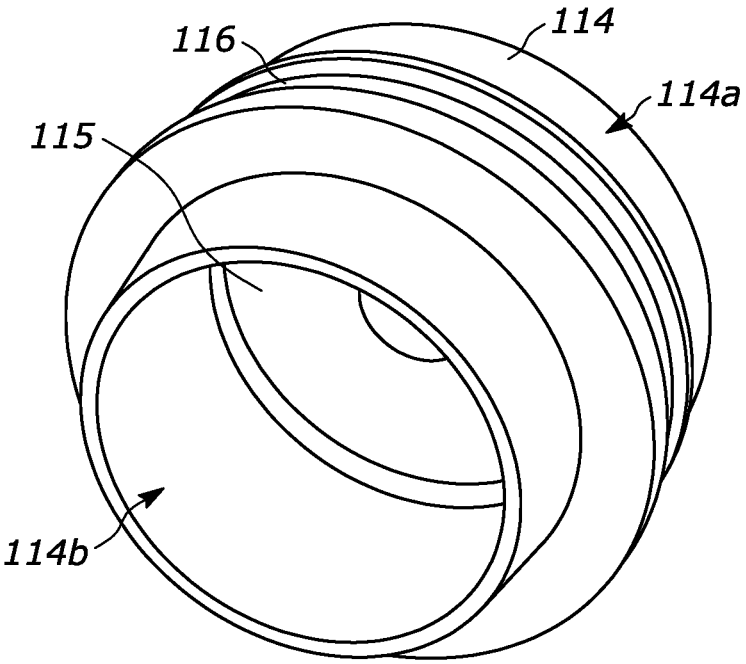
FIG. 14 illustrates a lower perspective view of the example container plug of FIG. 13 in accordance with various examples.

With reference to FIGS. 11 and 12, the container 110 includes a first end 110 *a*, a second end 110 *b*, and defines a cavity 110 *c* dimensioned to retain the cosmetic substance 101. The container 110 may be constructed from any number of suitable materials such as, for example, a polymeric material, a metallic material, and/or a glass material, and may accommodate between approximately 3 ml and approximately 15 ml of cosmetic substance 101. More specifically, in some examples, the cavity 105 may be dimensioned to accommodate approximately 6 ml of cosmetic substance 101. In some forms (not illustrated), the container 110 may be configured to receive an internal pouch that may be removable therefrom. Other examples are possible. In some examples, the first end 110 *a* of the container 110 may be open, and the second end 110 *b* of the container 110 may be closed. In some examples, and as illustrated in FIGS. 13 & 14, a separate container plug 114 is provided that removably couples with the second end 110 *b* of the container 110 to create a closed member. In the illustrated examples, the coupling between the container plug 114 and the container 110 may be a press or friction-fit connection. However, other arrangements (e.g., a threaded coupling) are possible.

The container plug 114 includes a wall 115 that separates the container plug 114 into an upper portion 114*a* and a lower portion 114*b*. Further, the container plug 114 includes any number of flanges or securement members 116 that may assist in creating a sealed coupling with the container 110. While not illustrated, the securement members 116 may be configured to receive an O-ring or other seal that engages the container 110. The wall 115 cooperates with the container 110 to define a lower limit of the cavity 110*c* that receives the cosmetic substance 101. Further, the upper end of the resilient member 107 may abut or otherwise rest against the wall 115 of the container plug 114. In this arrangement, the resilient member 107 urges the container plug 114, and therefore the container 110, towards the first end 102*a* of the body 102. In other words, the container 110 is movably disposed within the interior cavity 102*c* of the body 102.

Figure 15:
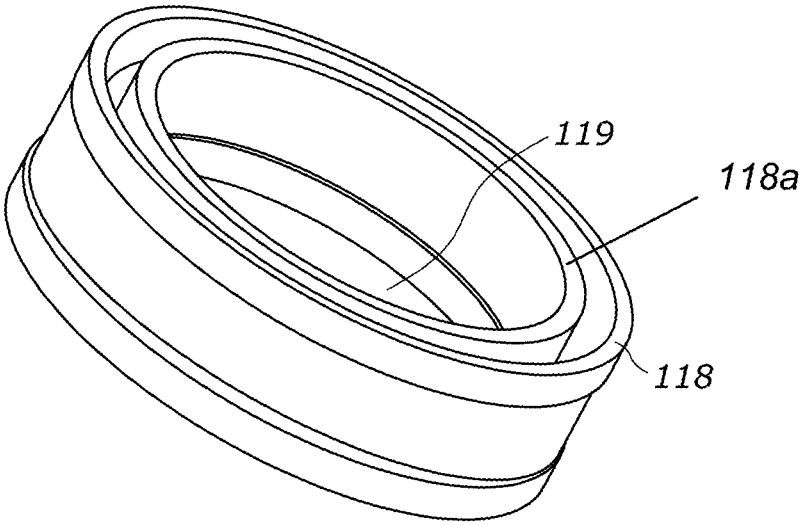
FIG. 15 illustrates a perspective view of an example sifter member of the example applicator system of FIGS. 1-13 in accordance with various examples.

Turning to FIG. 15, a sifter member 118 is provided that may be positioned within the body 102. The sifter member 118 is in the form of a generally cylindrical body and includes an abutment 118*a* on an outer periphery thereof as well as a screen 119 extending thereacross. In some arrangements, the sifter member 118 is fixedly coupled with the body 102. In other examples, the sifter member 118 may be in the form of a floating piston member that is slidably disposed within the container 110.

In some examples, the screen 119 is constructed from a metallic, mesh-like material, and in other examples, the screen 119 may be constructed from a polymeric material. More specifically, materials such as nylon polyurethane, polyamide, polyethylene, and the like may be used depending on the desired formula of the cosmetic substance 101 and its characteristics (e.g., the affinity of the cosmetic substance 101 towards the screen 119). Further, the material of the screen 119 may be determined based on desired hydrophobic or hydrophilic properties. As a non-limiting example, cosmetic substances 101 having more cake-like consistency may benefit from a screen 119 having hydrophobic properties, whereas cosmetic substances 101 having more runny consistencies may benefit from a screen 119 having hydrophilic treatments applied thereto. Other examples are possible. In these examples, the screen 119 has a desired porosity or opening dimension that will result in generating a surface tension for the cosmetic substance 101. The screen 119 provides a resistance to the flow of the cosmetic substance 101 that is equal to or greater than the pressure of the resilient member 107. As a non-limiting example, the screen 119 may have a pore size between approximately 100 μm and approximately 950 μm, which may vary and be selected depending on the consistency of the cosmetic substance 101 being dispensed. Further, the screen 119 may have a specific arrangement of pores to facilitate proper transfer of the cosmetic substance 101 onto the applicator 134. The sifter member 118, and more specifically the screen 119, cooperates with the container 110 and the container plug to define the cavity in which the cosmetic substance 101 is disposed.

The resilient member 107 is provided with a suitable spring force for the desired cosmetic substance 101 that causes the container 110 to be urged towards the first end 102*a* of the body 102 and additionally towards the sifter member 118. More specifically, the spring force of the resilient member 107 is sufficient to urge the container 110 to the point that the cosmetic substance 101 contacts or otherwise abuts the screen 119, but is insufficient to urge the cosmetic substance 101 through the pores or openings of the screen 119.

Figure 16:
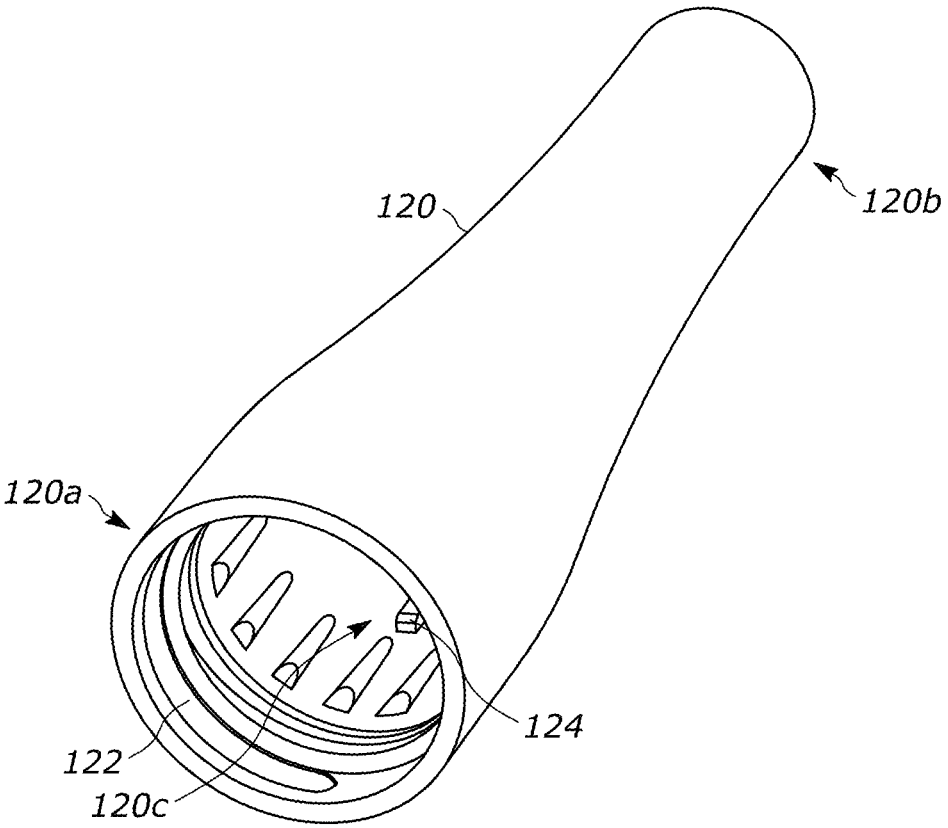
FIG. 16 illustrates a perspective view of an example handle of the example applicator system of FIGS. 1-15 in accordance with various examples.
Figure 17:
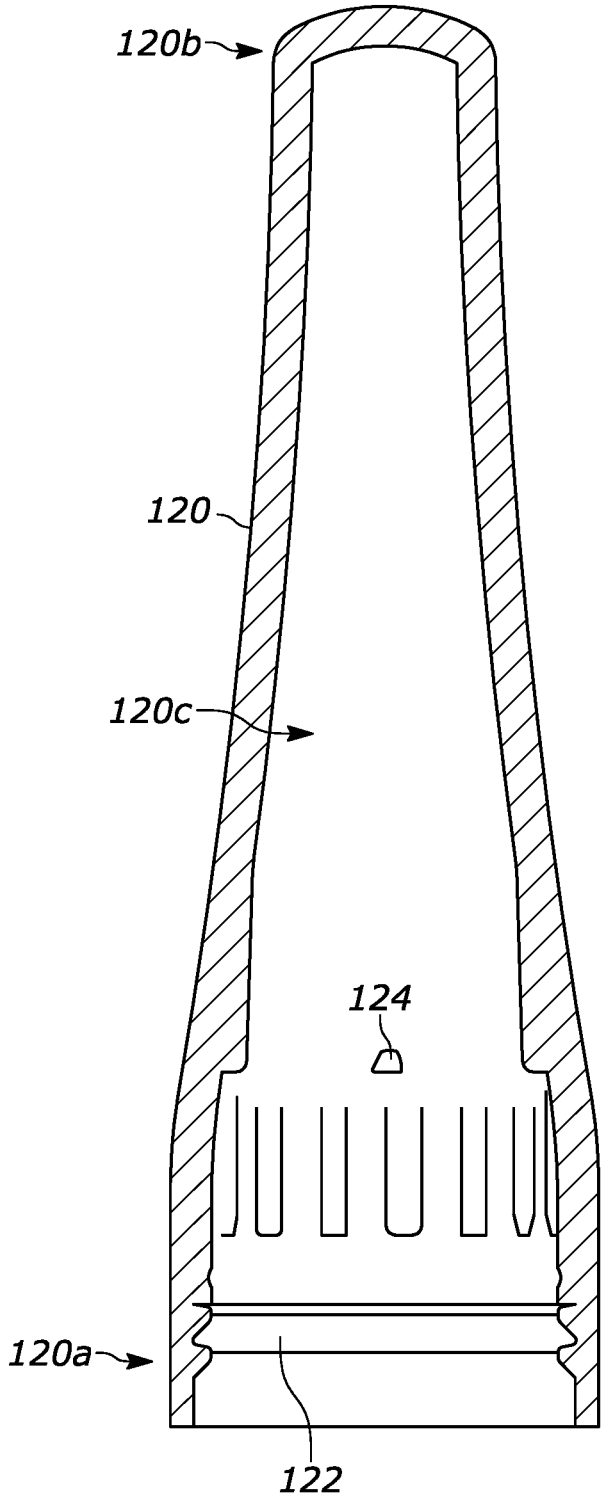
FIG. 17 illustrates a front elevation cross-sectional view of the example handle of FIG. 16 in accordance with various examples.

A handle 120 is illustrated in FIGS. 16 & 17. The handle 120 may include a first end 120*a*, a second end 120*b*, and defines an interior cavity 120*c*. In the illustrated example, the handle 120 has a generally tapered or tear-drop shape to assist with grippability by a user, but other configurations or arrangements are possible. The first end 120*a* of the handle may include a body coupling region 122. In the illustrated examples, the body coupling region 122 is in the form of a threaded arrangement that threadably engages the coupling region 105 of the body 102. Further, in the illustrated example, the threads forming the body coupling region 122 are disposed on an inner surface of the handle 120, but in other examples, the threads forming the body coupling region may be disposed on an outer surface of the handle. In other examples, other coupling mechanisms (e.g., a friction-fit coupling) are possible.

The handle 120 further includes an inner handle coupling region 124. In this example, the inner handle coupling region 124 is in the form of any number of protrusions or tabs. Other examples are possible.

Figure 18:
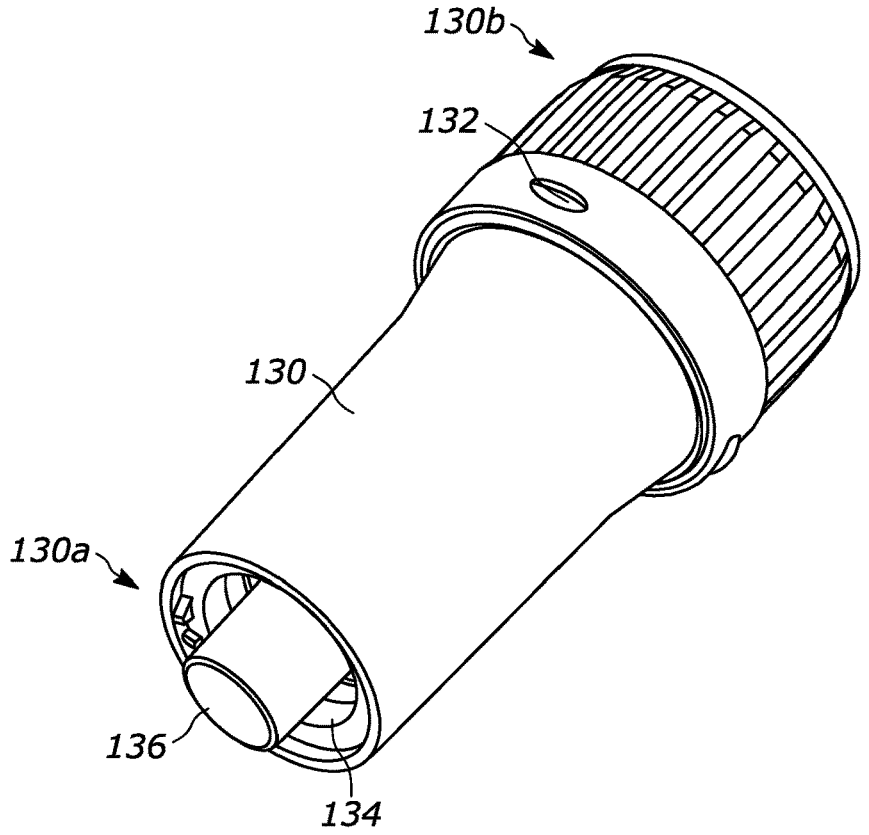
FIG. 18 illustrates a perspective view of an example inner handle of the example applicator system of FIGS. 1-17 in accordance with various examples.
Figure 19:
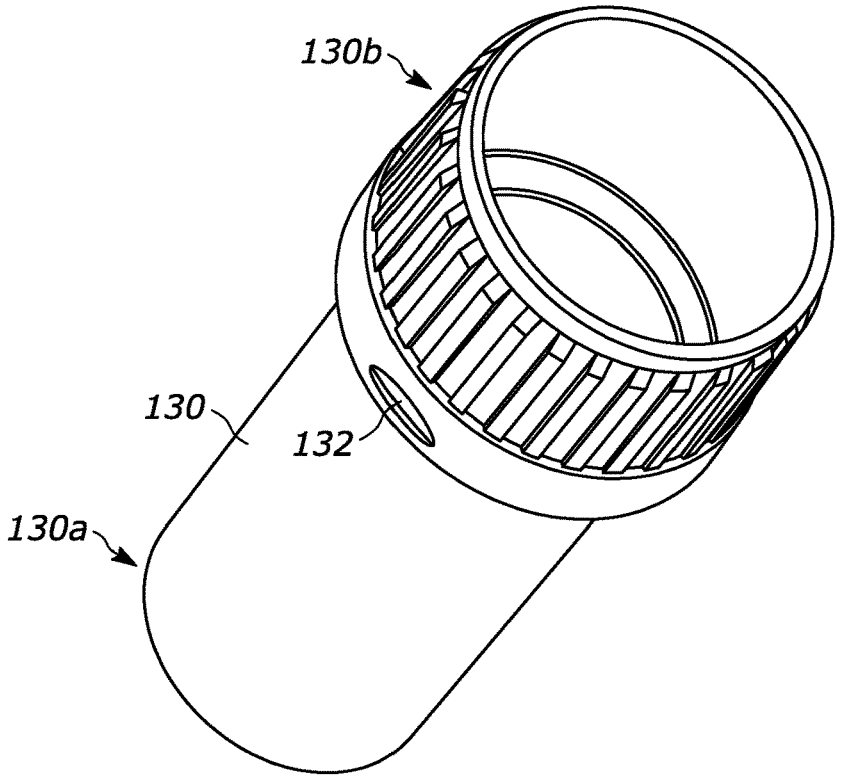
FIG. 19 illustrates a perspective view of an example inner handle of the example applicator system of FIGS. 1-18 in accordance with various examples.
Figure 20:
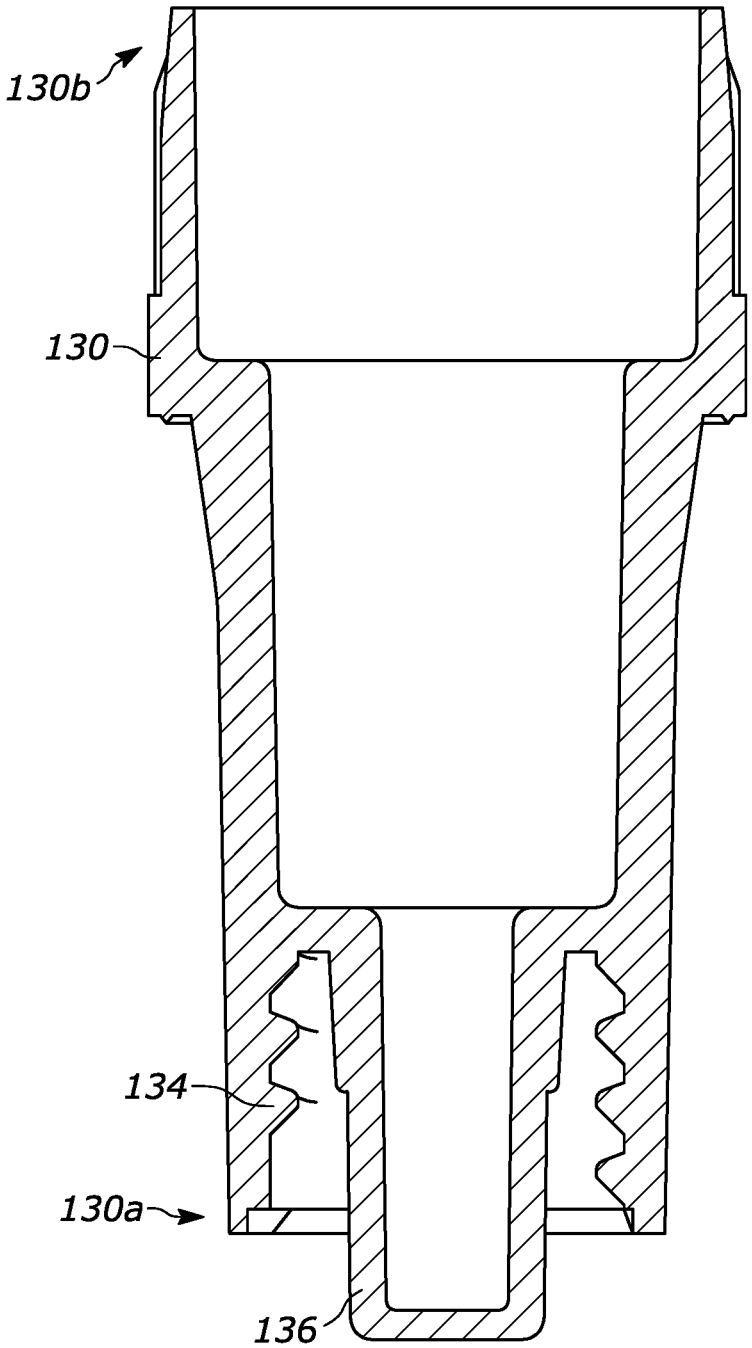
FIG. 20 illustrates a front elevation cross-sectional view of the example inner handle of FIGS. 18 & 19 in accordance with various examples.
Figure 21:
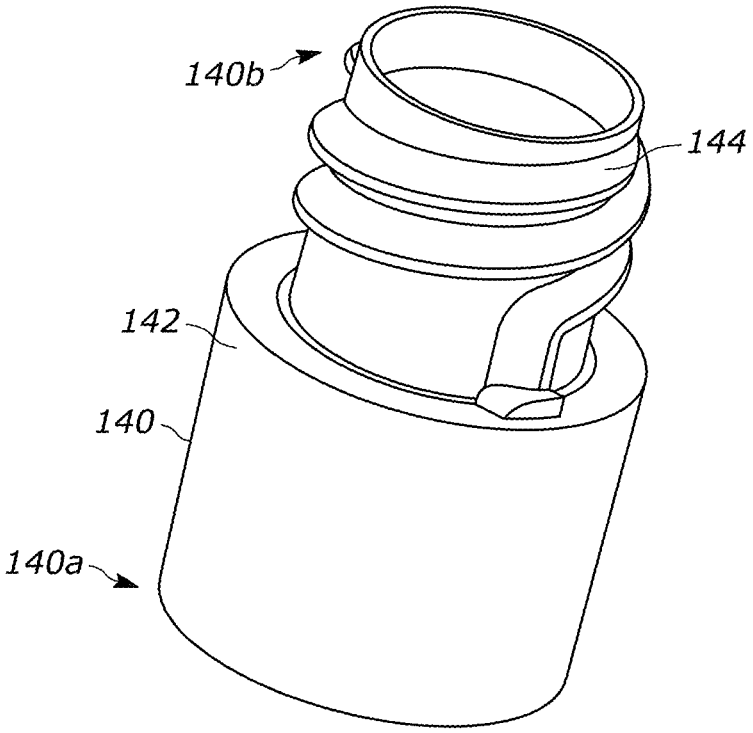
FIG. 21 illustrates a perspective view of an example applicator holder of the example applicator system of FIGS. 1-20 in accordance with various examples.
Figure 22:
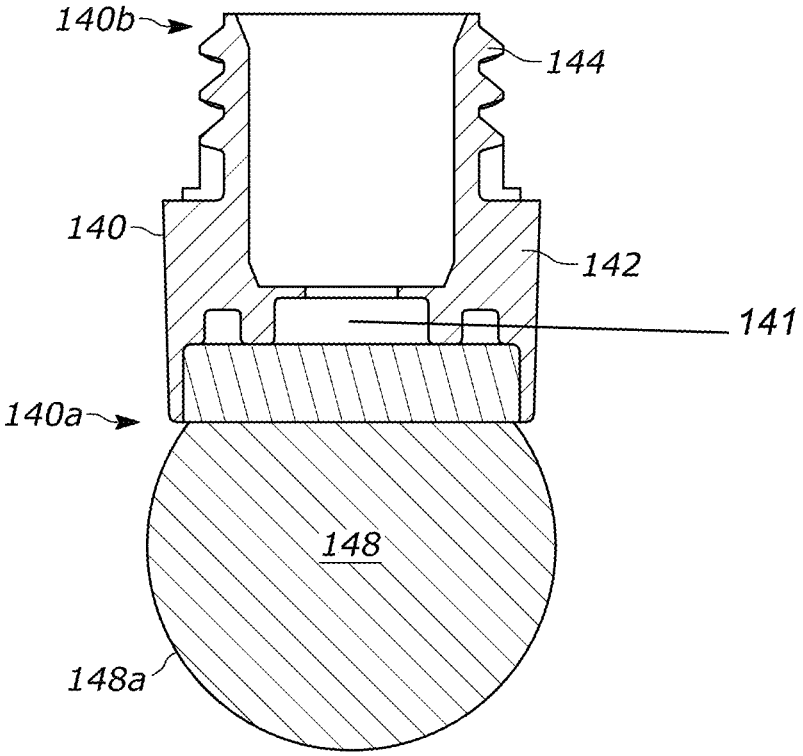
FIG. 22 illustrates a front elevation cross-sectional view of the example applicator holder of FIG. 21 in accordance with various examples.

Turning to FIGS. 18-20, an inner handle 130 is provided. The inner handle 130 is in the form of a body having a first end 130*a*, a second end 130*b*, a handle coupling mechanism 132, and an applicator coupling mechanism 134. As illustrated in FIGS. 18 & 19, the handle coupling mechanism 132 may be in the form of a bump or bumps positioned on an outer periphery of the inner handle 130. The inner handle 130 is at least partially disposed within the interior cavity 120*c* of the handle 120. More specifically, the second end 130*b* of the inner handle 130 is insertable into the interior cavity 120*c* of the handle until the handle coupling mechanism 132 is urged to engage the inner handle coupling region 124 formed on the handle 120. The bump or bumps 132 of the inner handle 130 and/or the protrusions 124 of the handle 120 may slightly deform to allow the bump or bumps 132 to move in an axial direction past the protrusions 124, whereupon the inner handle 130 may be removably retained within the interior cavity 120*c* of the handle 120. Other suitable coupling arrangements such as, for example, a threaded coupling, a friction-fit coupling, and the like, are possible. Further, in some examples, the inner handle 130 and the handle 120 may be integrally formed.

The applicator coupling mechanism 134 is in the form of a threaded arrangement surrounding a support finger 136. In the illustrated examples, the threaded arrangement is provided on an interior surface of the applicator coupling mechanism 134, but in other examples, other arrangements are possible.

The applicator 140 has a first end 140 *a*, a second end 140 *b*, a body 142 extending between the first and second ends 140 *a*, 140 *b*, an inner handle coupling mechanism 144, and a compressible member 148. The first end 140 *a* of the applicator 140 may define a cavity 141 that receives a portion of the compressible member 148. In some examples, the compressible member 148 includes a base that is constructed from a rigid or semi-rigid material that may be inserted and retained within the cavity 141.

In some examples, the compressible member 148 is constructed from a flocked soft foam having channels that allow the cosmetic substance 101 to be evenly dispersed about an external surface 148*a* thereof. By using a flocked foam, the external surface 148*a* allows for a smooth application of the cosmetic substance 101. In some examples, the channels may be laser-cut. In other words, the compressible member 148 may be micro-perforated to allow the cosmetic substance 101 to diffuse through and spread evenly at the external surface 148*a* of the compressible member 148. In some examples, the compressible member 148 is approximately 5 mm thick and may have a domed, slanted face having a petal shape that mimics a user's finger with a width of approximately 17 mm. In these and other examples, a tip of the compressible member 148 may be pointed to allow for targeted application of the cosmetic substance 101. Other examples are possible.

The second end 140 *b* of the applicator 140 may define a cavity that includes the inner handle coupling mechanism 144, which in the illustrated examples, is in the form of a threaded coupling region that allows the applicator 140 to threadably couple with the first end 130 *a* of the inner handle 130. Upon coupling the applicator 140 with the inner handle 130 via respective coupling mechanisms 134, 144, the finger 136 is at least partially disposed within the cavity formed at the second end 140 *b* off the applicator 140. So arranged, the finger 136 may align and support the applicator 140 when a user applies the cosmetic substance 101.

Figure 6:
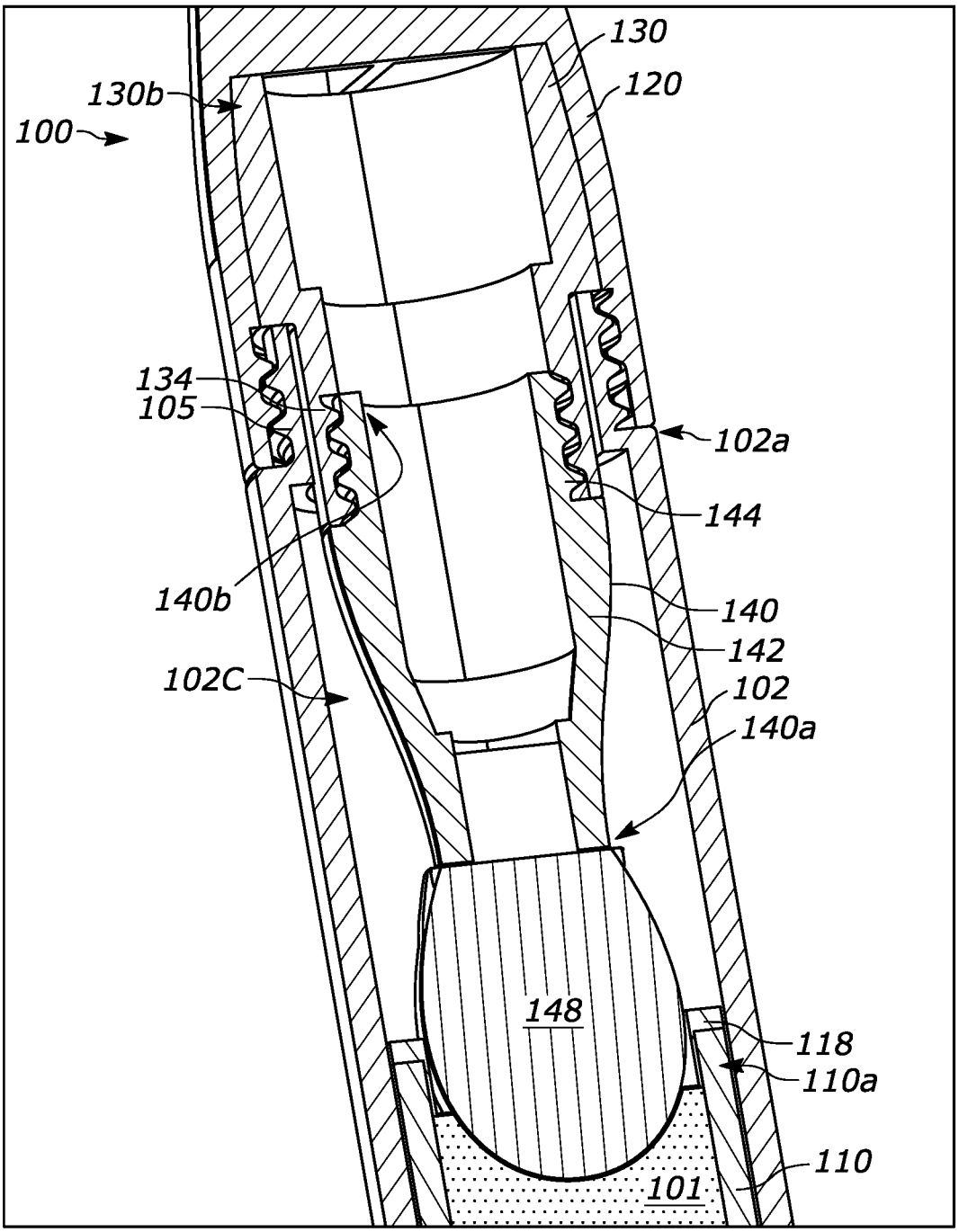
FIG. 6 illustrates a perspective cross-sectional view of the example applicator system of FIGS. 1-5 in accordance with various examples.

As previously noted, the applicator 140 is coupled with the inner handle 130, and the inner handle 130 is coupled with the handle 120. So arranged, and as illustrated in FIGS. 5 & 6, the first end 140 *a* of the applicator 140, which includes the compressible member 148, extends a length beyond the first end 120 *a* of the handle 120. Notably, the first end 120 *a* of the handle 120 and the first end 130 *a* of the inner handle 130 cooperate to define a gap dimensioned to receive the first end 102 *a* of the body 102. Accordingly, the threaded coupling region 105 of the body 102 may threadably and removably couple with the threaded body coupling region 122 to form a complete applicator 100. In this configuration, the applicator may be transported and stored while ensuring the cosmetic substance 101 does not leak from the container 110, and further ensures the compressible member 148 does not dry out.

As shown in FIGS. 5-7, coupling the handle 120 with the body 102 causes the compressible member 148 to be positioned and/or disposed within the body 102 adjacent to and/or within a portion (e.g., the first end 110*a*) of the container 110. More specifically, in this closed configuration, the compressible member 148 abuts and/or contacts the screen 119 of the sifter 118. In some examples, a portion of the applicator 140 may contact the abutment 118*a* of the sifter 118 to limit inward movement of the applicator 140.

As previously noted, the resilient member 107 of the piston assembly 106 urges the container 110, and thus the cosmetic substance 101, against the sifter 118 such that the screen 119 is "charged" or "loaded" with cosmetic substance 101. Upon coupling the handle 120 with the body 102, the compressible member 148 is urged against the screen 119, which causes the cosmetic substance 101 to flow through the screen 119 and into the compressible member 148 via capillary action. In some examples, the desired amount that the compressible member 148 compresses may be controlled based on the number of threads provided by the coupling region 105 of the body 102 and the body coupling region 122 of the handle 120. This dimension may be specified to ensure the compressible member 148 compresses to a point that a desired quantity of cosmetic substance 101 is collected by the compressible member 148.

Upon uncoupling the handle 120 from the body 102, the compressible member 148 will be loaded with cosmetic substance 101. The user may then apply the cosmetic substance 101 by pressing the external surface 148*a* of the compressible member 148 against their skin. Upon applying the cosmetic substance 101, the user may secure the handle 120 with the body 102.

As the cosmetic substance 101 is drawn from the container 110, the quantity of cosmetic substance 101 retained therein decreases. Accordingly, the piston assembly 106 causes the container 110 to again move towards the first end 102*a* of the body 102 until the cosmetic substance 101 abuts the screen 119 of the sifter 118. So configured, the piston assembly 106 again automatically charges or loads the screen 119 with the cosmetic substance such that upon securing the handle 120 with the body 102, the compressible member 148 is again loaded with cosmetic product 101. So arranged, a user needn't perform any additional steps beyond separating the handle 120 from the body 102 to apply the cosmetic substance 101.

In some examples, the sifter 118 may be "floating" and is not fixedly attached to the body 102 or the container 110, but instead, may freely move within the container 110 as the volume of cosmetic substance 101 disposed within the container decreases.

Because the applicator system 100 includes threadable or otherwise removable components, the applicator 140 may be separated from the remainder of the applicator system 100 as desired and interchanged with different applicators having desired geometries and/or other characteristics such as, for example, softer or more rigid foam materials. Further, the applicator 140 may be used alone (i.e., without using the inner handle 130 and/or the handle 120) as desired. Accordingly, the system 100 may be customizable to meet varying consumer demands. Such a removable arrangement further allows the applicator 140 to be adequately cleaned and replaced as needed, which may be advantageous in retail environments to promote hygienic practices.

Further, the applicator system 100 may be reusable. More specifically, in some examples, upon using all of the cosmetic substance 101, a user may remove the container 110 from the body 102 and return the container 110 to the manufacturer. The user may then purchase a standalone container having a seal or cap arrangement (not illustrated) on the first end 110*a* thereof, and subsequently place the container 110 within the body 102. Such a system may result in significant reductions in packaging waste.

So configured, the applicator 100 allows a consumer to collect, apply, and blend the product in a single swipe or motion. The applicator head geometry allows the product to diffuse to the surface for a more homogenous application, while the pointy upper region of the applicator head provides better application. The applicator 100 does not require a wiper, and as such, any number of suitable applicator head shapes may be used having soft or rigid structural characteristics. The package itself is self-dispensing as there is no actuator, push-button mechanism, or click-turn mechanism—instead, the product is ready for use once the body is removed from the container. Further, because each of the components are removably coupled with each other, the system 100 may be readily customized as desired by a user.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. An applicator system for containing and dispensing a cosmetic substance, the applicator system comprising:

a body including a first end, a second end, and defining an interior cavity;

a container at least partially disposed within the interior cavity of the body, the container defining a cavity containing a cosmetic substance;

a sifter positioned adjacent to the container to retain the cosmetic substance within the cavity;

a handle including a first end, a second end, and defining an interior cavity, the first end of the handle adapted to operably couple with the first end of the body;

an inner handle positioned at the first end of the handle, the inner handle including an applicator coupling mechanism and a support finger; and an applicator operably coupled with the applicator coupling mechanism of the inner handle, the applicator defining a cavity in which the support finger of the inner handle is at least partially disposed;

wherein upon operably coupling the first end of the body with the first end of the handle, the applicator is positioned adjacent to the sifter, thereby collecting a quantity of cosmetic substance, wherein the container is movably disposed within the body between the second end to the first end thereof, further comprising a Piston assembly positioned at the second end of the body, the piston assembly adapted to urge the container towards the first end of the body, wherein the sifter is fixedly coupled to the body and the Piston assembly generates a surface tension between the sifter and the cosmetic substance, wherein upon operably coupling the first end of the body with the first end of the handle, the applicator breaks the generated surface tension to cause the quantity of cosmetic substance to be collected thereon.

2. The applicator system of claim 1, wherein the piston assembly includes a resilient member operably coupled with the second end of the body.

3. The applicator system of claim 1, wherein the applicator is removably coupled with the applicator coupling mechanism of the inner handle.

4. The applicator system of claim 1, wherein the sifter further comprises an abutment to prevent the applicator from advancing into the container.

5. The applicator system of claim 1, wherein the first end of the body is threadably coupled with the first end of the handle.

6. The applicator system of claim 1, wherein the second end of the body is removable to allow the container to be removed therefrom.

7. The applicator system of claim 1, wherein the handle and the inner handle are integrally formed.

8. The applicator system of claim 1, wherein the sifter is at least partially constructed from a mesh material having a plurality of openings.

9. The applicator system of claim 8, wherein the sifter comprises a movable member adapted to translate within the interior cavity of the body.

10. A method for automatically dispensing a cosmetic substance, the method comprising:

providing a body including a first end, a second end, and defining an interior cavity, the body including a container at least partially disposed therein and defining a cavity containing a cosmetic substance;

positioning a sifter adjacent to the container to retain the cosmetic substance within the cavity, the sifter having a cylindrical structure fixedly coupled with the body and a screen extending across the cylindrical structure;

operably coupling a first end of a handle with the first end of the body, the handle including an interior cavity and an inner handle positioned at the first end of the handle, the inner handle being operably coupled with an applicator, wherein operably coupling the first end of the handle with the first end of the body causes the applicator to contact the sifter and collect a quantity of cosmetic substance; and decoupling the handle from the body to expose the applicator.

11. The method of claim 10, further comprising the step of upon decoupling the handle from the body, automatically advancing the container toward the first end of the body.

12. The method of claim 11, further comprising a piston assembly positioned at the second end of the body adapted to urge the container towards the first end of the body.

13. An applicator system for containing and dispensing a cosmetic substance, the system comprising:

a body including a first end, a second end, and defining an interior cavity;

a container at least partially disposed within the body, the container defining a cavity containing a cosmetic substance and being movable in an axial direction between the second end of the body and the first end of the body;

a sifter positioned adjacent to the container to retain the cosmetic substance within the cavity, the sifter having a cylindrical structure fixedly coupled with the body and a screen extending across the cylindrical structure; and a piston assembly positioned at the second end of the body, the piston assembly adapted to urge the container towards the first end of the body.

14. The applicator system of claim 13, wherein the piston assembly includes a resilient member operably coupled with the second end of the body.

15. The applicator system of claim 13, wherein the piston assembly generates a surface tension between the sifter and the cosmetic substance.

* * * * *